US008215998B1

(12) United States Patent
Ju et al.

(10) Patent No.: US 8,215,998 B1
(45) Date of Patent: Jul. 10, 2012

(54) ELECTRICAL CONNECTOR

(75) Inventors: Ted Ju, Keelung (TW); You Hua Cai, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/183,148

(22) Filed: Jul. 14, 2011

(30) Foreign Application Priority Data

Mar. 14, 2011 (CN) ..... 2011 2 0066490 U

(51) Int. Cl.
*H01R 24/28* (2011.01)

(52) U.S. Cl. ..... 439/660; 439/862; 439/626; 439/83

(58) Field of Classification Search ..... 439/626, 439/882–884, 862, 660
See application file for complete search history.

(56) References Cited

U.S. PATENT DOCUMENTS

| | | | | |
|---|---|---|---|---|
| 6,471,535 | B1 * | 10/2002 | Walkup et al. | 439/342 |
| 6,955,572 | B1 * | 10/2005 | Howell | 439/862 |
| 7,074,048 | B2 * | 7/2006 | Liao et al. | 439/66 |
| 7,086,903 | B2 * | 8/2006 | Takada | 439/628 |
| 7,291,021 | B2 * | 11/2007 | Shirai et al. | 439/71 |
| 7,445,464 | B2 * | 11/2008 | Ma et al. | 439/71 |
| 7,878,818 | B2 * | 2/2011 | Cheng et al. | 439/66 |
| 7,909,617 | B2 * | 3/2011 | Liao et al. | 439/71 |
| 7,922,548 | B2 * | 4/2011 | Fan | 439/862 |
| 8,118,603 | B2 * | 2/2012 | Ho | 439/70 |
| 2003/0203664 | A1 * | 10/2003 | Koopman et al. | 439/71 |
| 2004/0209492 | A1 * | 10/2004 | Kajinuma et al. | 439/71 |
| 2007/0202715 | A1 * | 8/2007 | Daily et al. | 439/71 |
| 2007/0298657 | A1 * | 12/2007 | Ju | 439/607 |
| 2008/0081490 | A1 * | 4/2008 | Hsieh | 439/71 |
| 2008/0171478 | A1 * | 7/2008 | Tsai | 439/862 |
| 2010/0216344 | A1 * | 8/2010 | Fan | 439/626 |
| 2011/0256771 | A1 * | 10/2011 | Jin | 439/626 |

* cited by examiner

*Primary Examiner* — Briggitte R Hammond
(74) *Attorney, Agent, or Firm* — Morris Manning & Martin LLP; Tim Tingkang Xia, Esq.

(57) ABSTRACT

An electrical connector for electrically connecting a chip module includes: an insulating body, located below the chip module and opened with at least two rows of receiving holes arranged front and back in a staggered manner; a plurality of solder balls, accommodated in the insulating body; a plurality of conductive terminals, each having a base fixed in the receiving hole, in which an elastic arm is bent and extends upwards from the base, and the elastic arm has a contact portion for conducting the chip module upwards. The bases of the same row are arranged in the same line, the contact portions of the back row do not exceed the line of the front row before the chip module presses the contact portions downwards, and the contact portions of back row exceed the line of the front row after the chip module presses the contact portions downwards.

9 Claims, 8 Drawing Sheets

ELECTRICAL CONNECTOR

CROSS-REFERENCE TO RELATED APPLICATIONS

This non-provisional application claims priority under 35 U.S.C. §119(a) on Patent Application No. 201120066490.7 filed in China on Mar. 14, 2011, the entire contents of which are hereby incorporated by reference.

FIELD OF THE INVENTION

The present invention relates to an electrical connector, and more particularly to an electrical connector for positioning a chip module onto a circuit board.

BACKGROUND OF THE INVENTION

An electrical connector is widely applied to position a chip module onto a circuit board. The development of technology requires higher performance of the chip module. Different chip modules need different electrical connectors, so the arrangement of the conductive terminals on the electrical connector becomes increasingly denser. Therefore, the electrical connector needs a sufficient normal force to ensure a stable and good electrical connection between the chip module and the circuit board.

An electrical connector commonly seen in the industry for electrically connecting a chip module includes: an insulating body, having a plurality of receiving holes arranged in matrix; and a plurality of conductive terminals, each having a base fixed in the receiving hole, in which an elastic arm is bent and extends upwards from the base, and the bases of the terminals at the same row are arranged in the same line. To provide a sufficient normal force and provide enough space for deformation of the elastic arms when the chip module presses the electrical connector downwards, a sufficient distance is kept between the receiving holes of adjacent rows on the electrical connector, so that the elastic arms when deformed under a force does not exceed the line of the front row.

Therefore, although the above electrical connector structure can provide a sufficient normal force, the sufficient distance kept between the receiving holes of adjacent rows is not beneficial for the dense arrangement of the conductive terminals on the electrical connector.

To achieve the dense arrangement of the conductive terminals and enable the electrical connector to provide a sufficient normal force, another electrical connector for electrically connecting a chip module is disclosed and includes: an insulating body, having multiple rows of receiving holes arranged in a staggered manner; and a plurality of conductive terminals, each having a base fixed in the receiving holes, in which an elastic arm is bent and extends upwards from the base towards the conductive terminals of the front row, the bases of the terminals at the same row are arranged in the same line, and the elastic arms of the back row exceed the line of the front row. As such, the electrical connector is enabled to provide a sufficient normal force, and meanwhile it is beneficial for the dense arrangement of the conductive terminals. However, the elastic arms exceed the line of the front row before the chip module is pressed downwards, and the bases of the same row are connected by a shared strip, that is, before the chip module is pressed downwards, the elastic arms exceed the strip of the front row in spatial distance. As a result, when the strip is operated to insert the conductive terminals onto the insulating body, the operator must insert the conductive terminals in a predetermined direction, and if the insertion direction is not the predetermined direction, the conductive terminals and the strips of the adjacent rows may scratch or collide with each other, causing damage to the conductive terminals, thus influencing the stable buckling connection of the electrical connector structure.

Therefore, a heretofore unaddressed need exists in the art to address the aforementioned deficiencies and inadequacies.

SUMMARY OF THE INVENTION

In one aspect, the present invention is directed to an electrical connector, which is convenient to assemble and can provide a sufficient normal force.

In one embodiment, the present invention provides an electrical connector for electrically connecting a chip module. The electrical connector includes: an insulating body, located below the chip module and opened with at least two rows of receiving holes arranged front and back in a staggered manner; a plurality of solder balls, accommodated in the insulating body; a plurality of conductive terminals, each having a base fixed in the receiving hole, in which an elastic arm is bent and extends upwards from the base, and the elastic arm has a contact portion for conducting the chip module upwards. The bases of the conductive terminals of the same row are arranged in the same line, the contact portions of the conductive terminals of the back row do not exceed the line of the front row before the chip module presses the contact portions downwards, and the contact portions of the conductive terminals of the back row exceed the line of the front row after the chip module presses the contact portions downwards.

Compared with the related art, before the chip module presses the contact portions downwards, the contact portions of the terminals of the back row do not exceed the line of the front row, so that when the strip is operated to insert the conductive terminals onto the insulating body, the operator can insert the conductive terminals from different directions, which is convenient to operate. After the chip module presses the contact portions downwards, the contact portions of the terminals of the back row exceed the line of the front row. Under the condition that the arrangement of the receiving holes of the insulating body is predetermined, after the contact portions of the terminals of the back row exceed the line of the front row, the length of the arm of force of the contact portions can be extended, thereby increasing the normal force. On the other hand, under the condition that the arm of force of the contact portion is predetermined, after the contact portions of the conductive terminals of the back row exceed the line of the front row, the distance between the receiving holes of the front and back rows can be reduced, which is beneficial for the dense arrangement of the conductive terminals on the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
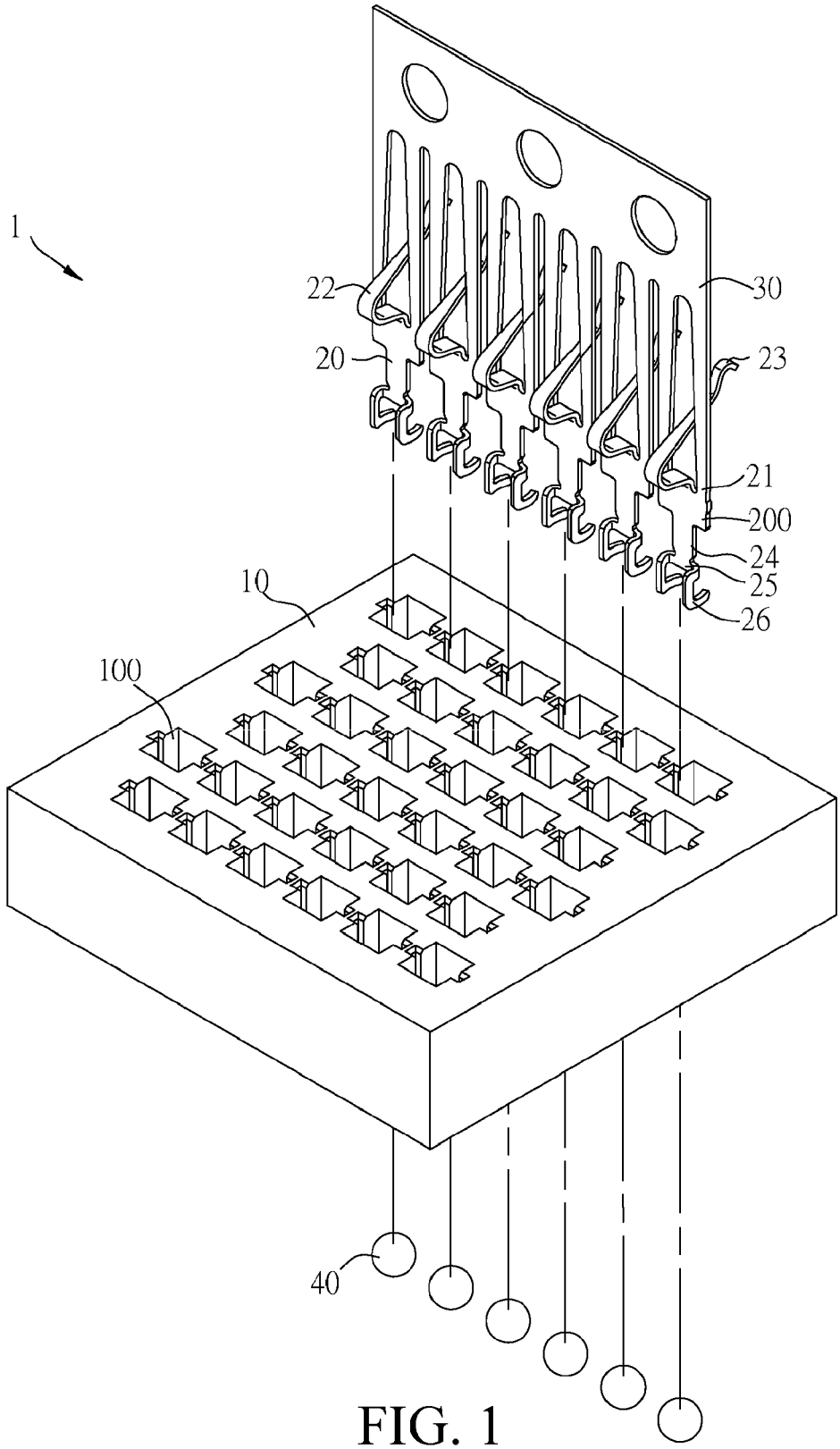
FIG. 1 is a three-dimensional exploded view of an electrical connector in one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 2:
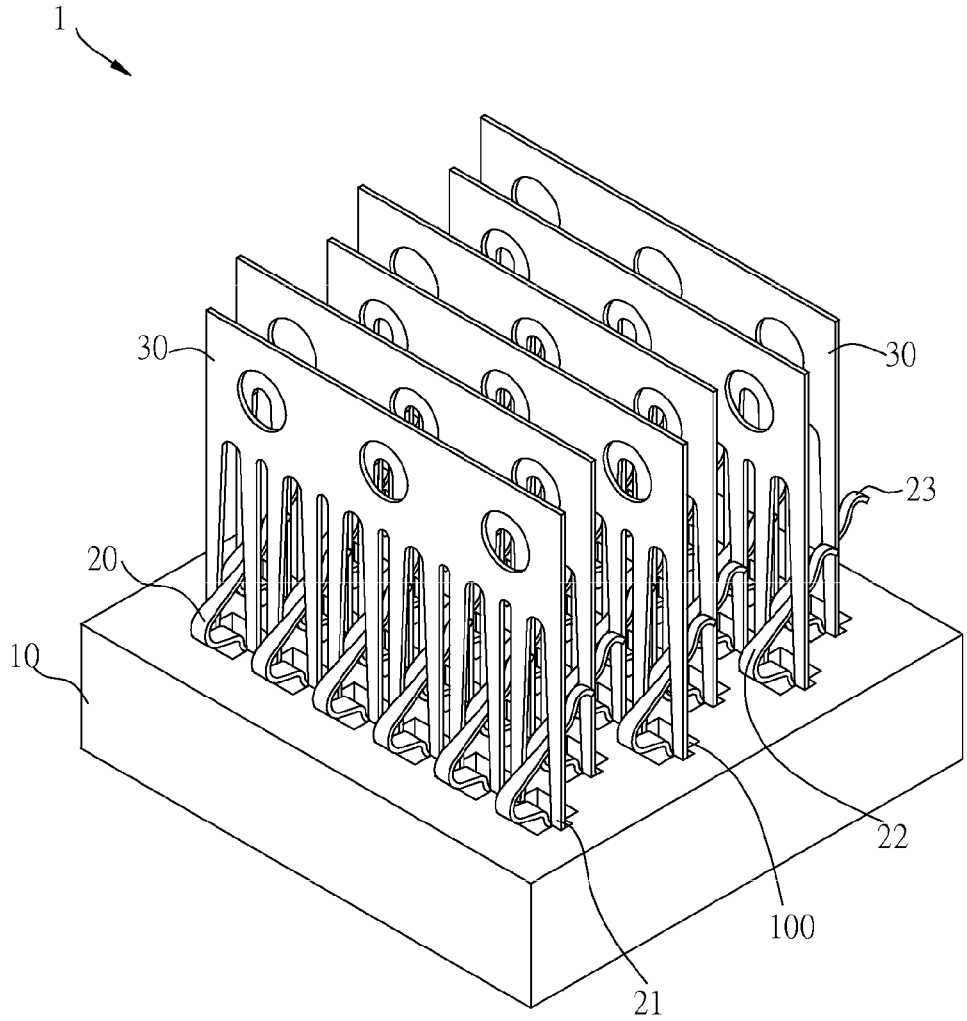
FIG. 2 is a three-dimensional assembled view of the electrical connector in the embodiment.
Figure 3:
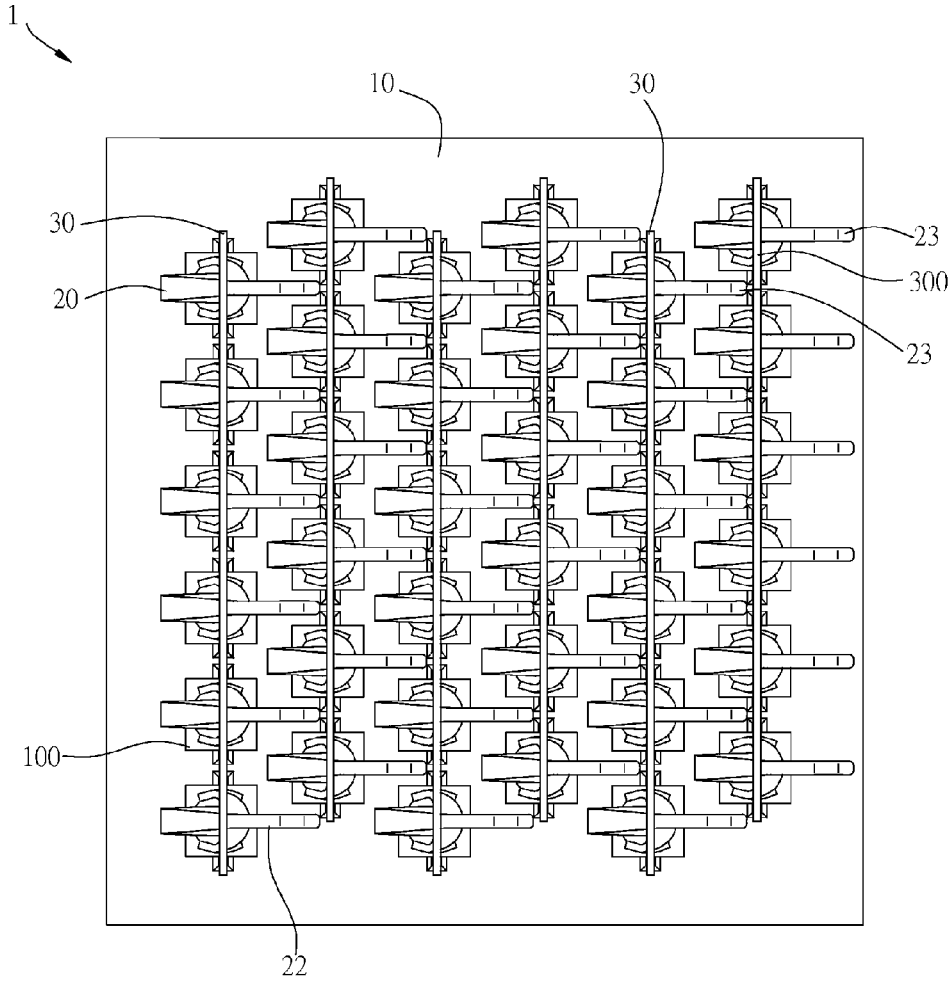
FIG. 3 is a top view of the electrical connector in the embodiment.
Figure 4:
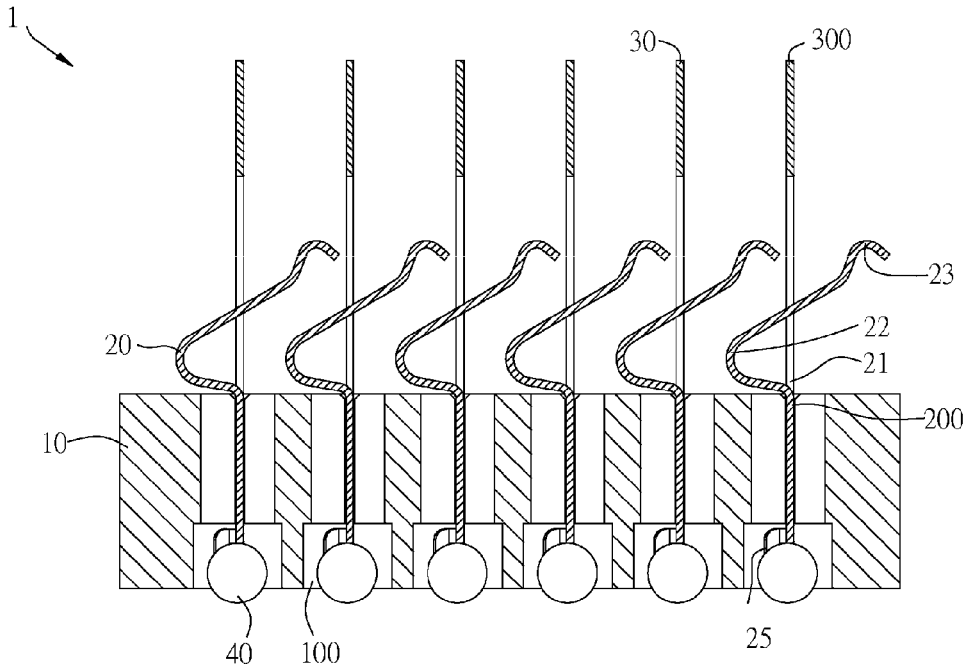
FIG. 4 is a sectional view of the electrical connector in the embodiment before the strips are broken.

Referring to FIGS. 1-3, the electrical connector 1 of the present invention is used for electrically connecting a chip module 2 to a circuit board (not shown).

Referring to FIGS. 1-3, the electrical connector 1 includes an insulating body 10, opened with multiple rows of receiving holes 100 arranged front and back; a plurality of conductive terminals 20, accommodated in the receiving holes 100; a plurality of strips 30, each strip 30 connecting the conductive terminals 20 of the same row; and a plurality of solder balls 40, accommodated in the insulating body 10.

Referring to FIGS. 1-3, the insulating body 10 is located below the chip module 2 and is made of an insulating material such as plastic. The multiple rows of the receiving holes 100 are arranged front and back in a staggered manner on the insulating body 10, the receiving holes 100 of the back row are sequentially located behind and between every two adjacent receiving holes 100 of the front row, and the receiving holes 100 are formed through a top surface and a bottom surface of the insulating body 10.

Referring to FIGS. 1-3, each conductive terminal 20 has a base 200 fixed in the receiving hole 100, and the bases 200 of the conductive terminals 20 of the same row are arranged in the same line 300. A strip connecting portion 21 respectively extends upwards from two sides of the base 200, and an elastic arm 22 is bent backwards and then forwards from the top portion of the base 200. The elastic arm 22 is correspondingly located right above the receiving hole 100, and the two strip connecting portions 21 are located on two sides of the elastic arm 22. A tail end of the elastic arm 22 has a contact portion 23 for conducting the chip module 2 upwards, and the elastic arms 22 of the conductive terminals 20 of the back row are sequentially located behind and between every two adjacent conductive terminals 20 of the front row. A transition portion 24 and a soldering portion 25 sequentially extend downwards from the base 200, the transition portion 24 connects the base 200 and the soldering portion 25, and the width of the transition portion 24 is smaller than the width of the base 200, so that the elasticity of the overall structure of the conductive terminals 20 can be enhanced. A fixing portion 26 respectively extends downwards from two sides of the soldering portion 25, and the two fixing portions 26 jointly clamp and conduct the solder ball 40 accommodated in the electrical connector 10 to the circuit board (not shown).

Referring to FIG. 1, FIG. 2 and FIG. 3, the strip 30 is connected to the conductive terminals 20 through the strip connecting portion 21, and the strip 30 connects the bases 200 of the conductive terminals 20 of the same row. The horizontal projection of the strip 30 overlaps that of the line 300 in which the conductive terminals 20 of the same row are arranged. The strip 30 is used for connecting the conductive terminals 20 of the same row, so that the conductive terminals 20 of the same row may be inserted into the receiving holes 100 at one time. The strip 30 is broken after the conductive terminals 20 are inserted, so that the height of the arrangement space of the electrical connector 10 remains unchanged.

Referring to FIGS. 1-4, in operation, first, each row of the conductive terminals 20 connected with the strip 30 are correspondingly inserted into the receiving holes 100. Then, referring to FIG. 5 and FIG. 6, the strip 30 is broken, and at this time the bases 200 of the conductive terminals 20 of the same row are arranged in the same line 300, and the contact portions 23 of the conductive terminals 20 of the back row do not exceed the line 300 of the front row.

Figure 5:
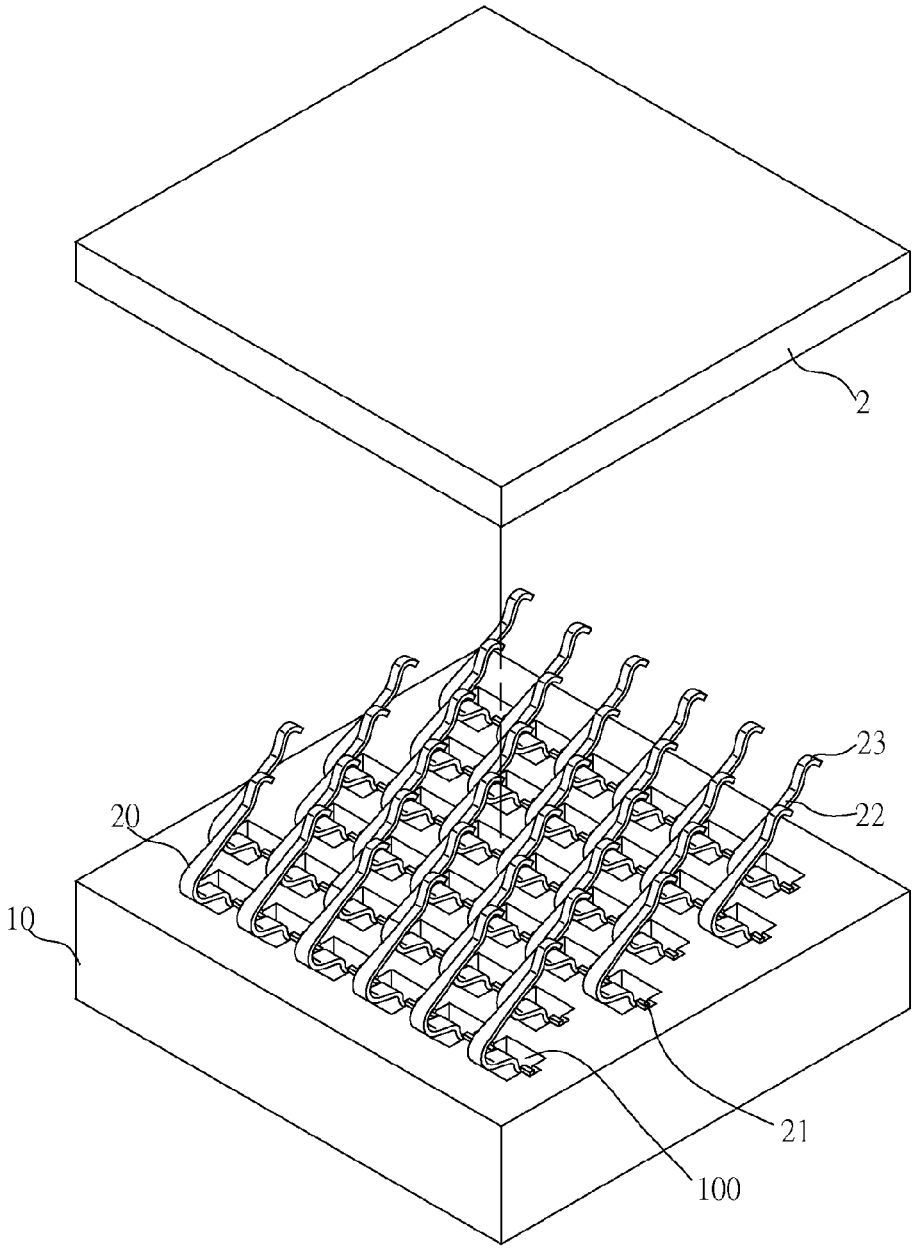
FIG. 5 is a three-dimensional exploded view of the electrical connector in the embodiment after the strips are broken and before the chip module is pressed down.
Figure 6:
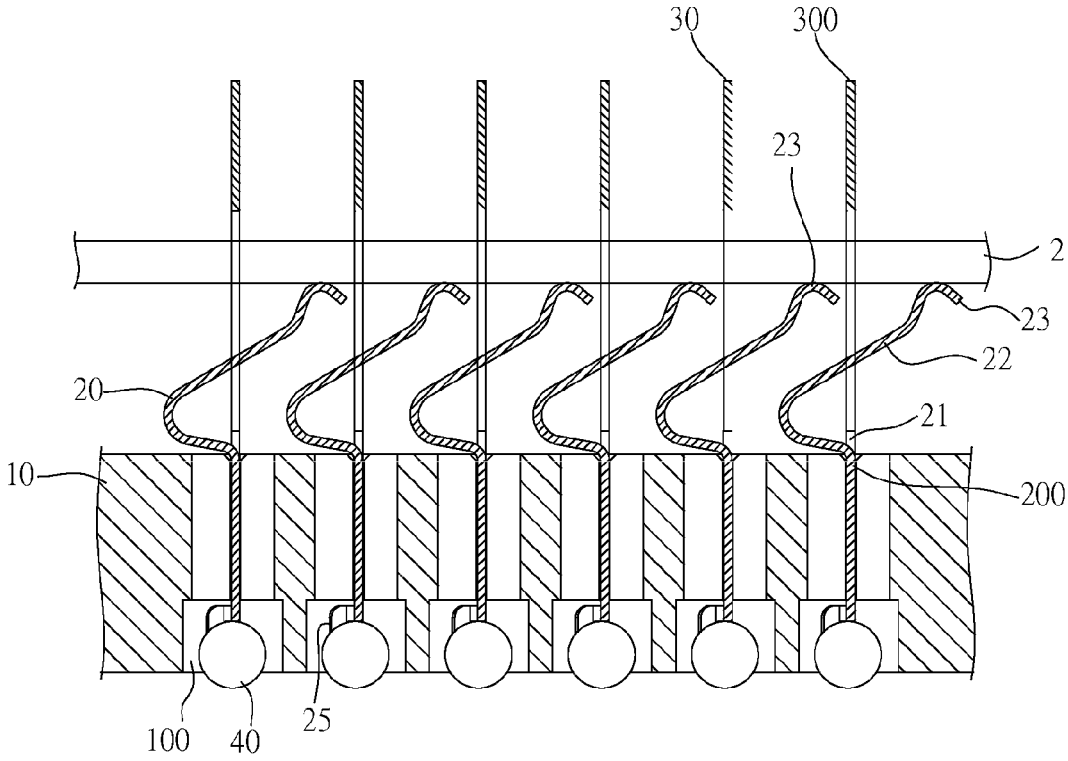
FIG. 6 is a sectional view of the electrical connector in the embodiment after the strips are broken and before the chip module is pressed down.
Figure 7:
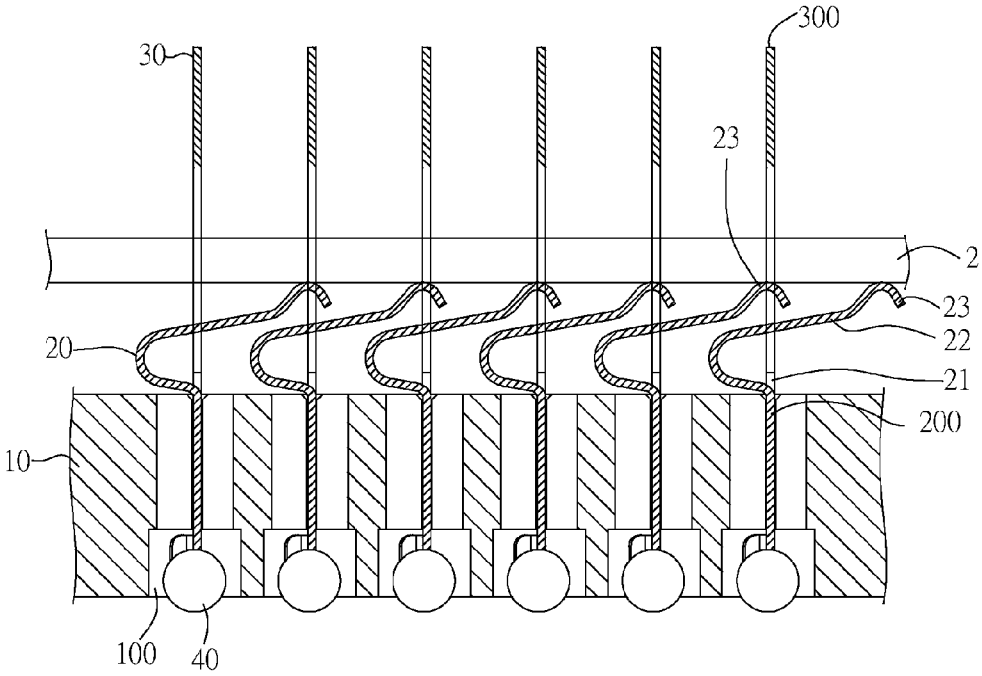
FIG. 7 is a sectional view of the electrical connector in the embodiment after the chip module is pressed down.
Figure 8:
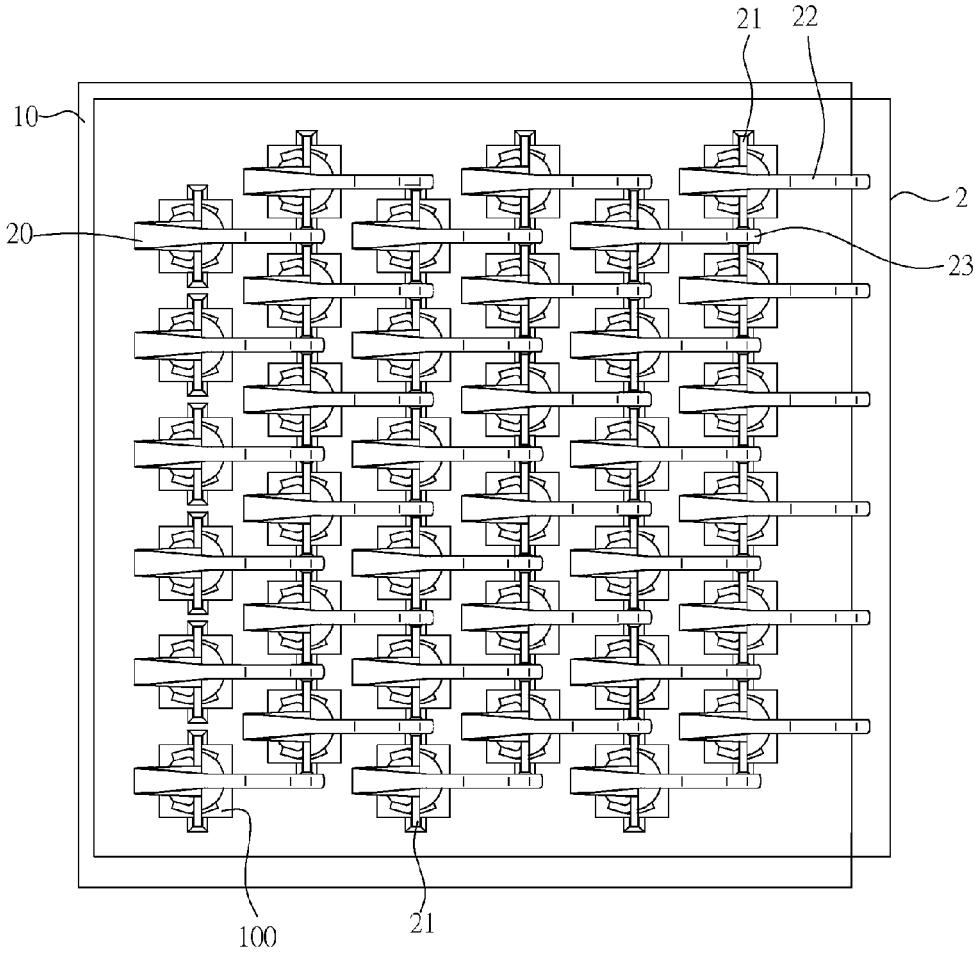
FIG. 8 is a top view of the electrical connector in the embodiment after the chip module is pressed down.

Referring to FIG. 5 and FIG. 6, the chip module 2 is disposed above the electrical connector 10, and a downward action force is exerted on the chip module 2, so that the chip module 2 presses the electrical connector 10 downwards. At this time, the contact portion 23 that conducts the chip module 2 upwards is deformed downwards and towards the conductive terminals 20 of the front row. Referring to FIG. 7 and FIG. 8, the downward action force is continuously exerted to ensure the complete electrical conduction between the contact portion 23 and the chip module 2. The contact portion 23 is forced to approach the line 300 of the front row from back to front and finally exceeds the line 300 of the front row. The horizontal projection of the contact portion 23 of the back row is correspondingly located between two conductive terminals 20 of the front row but not in contact with the two conductive terminals 20, thereby effectively preventing short circuit between the contact portion 23 when pressed down and the conductive terminals 20 of the front row.

Based on the above, the electrical connector of the present invention, among other things, has the following beneficial effects.

1. Before the chip module presses the contact portions downwards, the contact portions of the terminals of the back row do not exceed the line of the front row, so that when the strip is operated to insert the conductive terminals onto the insulating body, the operator can insert the conductive terminals from different directions, which is convenient to operate.

2. Under the condition that the arrangement of the receiving holes of the insulating body is predetermined, after the contact portions of the terminals of the back row exceed the line of the front row, the length of the arm of force of the contact portions can be extended, thereby increasing the normal force.

3. Under the condition that the arm of force of the contact portion is predetermined, after the contact portions of the conductive terminals of the back row exceed the line of the front row, the distance between the receiving holes of the front and back rows can be reduced, which is beneficial for the dense arrangement of the conductive terminals on the electrical connector.

4. The horizontal projection of the contact portion of the back row is correspondingly located between two conductive terminals of the front row but not in contact with the two conductive terminals, thereby effectively preventing short circuit between the contact portion when pressed down and the conductive terminals of the front TOW.

5. The width of the transition portion is smaller than the width of the soldering portion, so that the elasticity of the overall structure of the conductive terminals can be enhanced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, for electrically connecting a chip module, comprising:

(a) an insulating body, located below the chip module and opened with at least two rows of receiving holes arranged front and back in a staggered manner;

(b) a plurality of solder balls, accommodated in the insulating body; and (c) a plurality of conductive terminals, each having a base fixed in the receiving hole, wherein an elastic arm is bent and extends upwards from the base, and the elastic arm has a contact portion for conducting the chip module upwards;

wherein the bases of the conductive terminals of the same row are arranged in the same line, the contact portions of the conductive terminals of the back row do not exceed the line of the front row before the chip module presses the contact portions downwards, and the contact portions of the conductive terminals of the back row exceed the line of the front row after the chip module presses the contact portions downwards.

2. The electrical connector according to claim 1, wherein the elastic arm is bent and extends backwards and then forwards from a top end of the base.

3. The electrical connector according to claim 1, wherein a strip connecting portion respectively extends upwards from two sides of the base, and the two strip connecting portions are located on two sides of the elastic arm.

4. The electrical connector according to claim 1, wherein the receiving holes of the back row are sequentially located behind and between every two adjacent receiving holes of the front row.

5. The electrical connector according to claim 1, wherein the elastic arms of the conductive terminals of the back row are sequentially located behind and between every two adjacent conductive terminals of the front row.

6. The electrical connector according to claim 1, wherein the elastic arm is correspondingly located right above the receiving hole.

7. The electrical connector according to claim 1, wherein after the chip module presses the contact portions downwards, a horizontal projection of the contact portion of the back row is correspondingly located between two conductive terminals of the front row.

8. The electrical connector according to claim 1, wherein a transition portion and a soldering portion sequentially extend downwards from the base, the transition portion connects the base and the soldering portion, and the width of the transition portion is smaller than the width of the base.

9. The electrical connector according to claim 1, wherein the soldering portion has a connecting portion and a fixing portion respectively extending downwards from two sides of the connecting portion, and the two fixing portions jointly clamp the solder ball.

* * * * *